US006481496B1

(12) United States Patent
Jackson et al.

(10) Patent No.: US 6,481,496 B1
(45) Date of Patent: Nov. 19, 2002

(54) WELL PACKER AND METHOD

(75) Inventors: Stephen L. Jackson, Richmond, TX (US); David R. Mandeville, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/593,840

(22) Filed: Jun. 14, 2000

Related U.S. Application Data

(60) Provisional application No. 60/139,708, filed on Jun. 17, 1999.

(51) Int. Cl.[7] ..... E21B 23/06

(52) U.S. Cl. ..... 166/120; 166/123; 166/125

(58) Field of Search ..... 166/386, 387, 166/125, 123, 120, 181, 182

(56) References Cited

U.S. PATENT DOCUMENTS

| | | | | |
|---|---|---|---|---|
| 3,196,948 A | | 7/1965 | Dye | |
| 3,734,179 A | | 5/1973 | Smedley | |
| 3,830,295 A | | 8/1974 | Crowe | |
| 3,899,631 A | | 8/1975 | Clark | |
| 4,022,273 A | | 5/1977 | Marathe | |
| 4,289,200 A | * | 9/1981 | Fisher, Jr. | 166/120 |
| 4,438,811 A | * | 3/1984 | Patel | 166/123 |
| 4,487,258 A | * | 12/1984 | Jackson et al. | 166/120 |
| 4,798,243 A | | 1/1989 | Curington et al. | |
| 4,834,175 A | * | 5/1989 | Ross et al. | 166/120 |
| 4,834,184 A | | 5/1989 | Streich et al. | |
| 4,917,187 A | | 4/1990 | Burns et al. | |
| 5,096,209 A | | 3/1992 | Ross | |
| 5,103,902 A | * | 4/1992 | Ross et al. | 166/120 |
| 5,152,340 A | | 10/1992 | Clark et al. | |
| 5,184,677 A | | 2/1993 | Dobscha et al. | |
| 5,271,468 A | | 12/1993 | Streich et al. | |
| 5,337,808 A | | 8/1994 | Graham | |
| 5,479,991 A | | 1/1996 | Robison et al. | |
| 5,803,170 A | | 9/1998 | Garcia-Soule et al. | |
| 5,810,083 A | * | 9/1998 | Kilgore | 166/120 |
| 6,112,811 A | * | 9/2000 | Kilgore et al. | 166/134 |
| 6,202,747 B1 | * | 3/2001 | Lacy et al. | 166/120 |

FOREIGN PATENT DOCUMENTS

| | | |
|---|---|---|
| WO | WO 98/21445 | 5/1998 |

* cited by examiner

*Primary Examiner*—Hoang Dang
(74) *Attorney, Agent, or Firm*—Fletcher, Yoder & Van Someren; Jeffrey E. Griffin; Brigitte L. Jeffery

(57) ABSTRACT

A releasable packer has a control line therethrough. A hydraulic release mechanism of the packer is controlled from the surface by application of flow and pressure. A modification of the packer and release mechanism using resettable collets and return springs allows multiple sets and releases of the packer.

27 Claims, 9 Drawing Sheets

WELL PACKER AND METHOD

CROSS-REFERENCE TO RELATED APPLICATIONS

This application is based on and claims the priority of provisional application No. 60/139,708, filed on Jun. 17, 1999 and entitled Well Packer and Method.

FIELD OF THE INVENTION

The present invention relates to the field of downhole tools. More specifically, the invention relates to a device and method for directing bypass lines through a packer and for releasing a packer using flow through at least one of the bypass lines.

BACKGROUND OF THE INVENTION

Completion systems require or may require control lines and telemetering lines that may be either electric, hydraulic, or fiber optic. Using the control lines, various tools may be set or unset, gauges and other equipment may be powered, monitored, and controlled, and other actions may be performed using the control lines.

Well completions typically include a casing extending from a surface wellhead to the producing formation, a production tubing located within the casing, and one or more other completion devices. One such completion device is commonly called a packer and is used to block, pack off, and seal the annulus formed between the casing and the production tubing. Placement of one or more packers in this way directs the production fluid into the production tubing. Packers are also used for other purposes, such as during cementing, gravel packing, and during other procedures.

However, the packer presents an obstacle to the control and telemetering lines and the like (commonly referred to herein as "control lines"), because the control lines are typically run between the tubing and the casing. Accordingly, there is a need for a bypass through the packer to allow communication of the control lines through the packer.

Often, there is a need for a packer that may be set and, at some later time, released. In some cases, it may be necessary to place multiple, spaced packers in a well in which the packers are all set and subsequently released. Typically, the release of such packers is accomplished by pulling the tubing for release or using other mechanical release devices. However, such release devices may inadvertently release by inadvertent pulls on the tubing. Further, there is also a need for packers that may be set and released a plurality of times.

There remains a need for a packer that may be set and unset using, for example, hydraulic means and that provides communication and protection for control lines through the packer.

SUMMARY OF THE INVENTION

The present invention features a hydraulically releasable well packer that has a plurality of bypass passages to allow control lines to pass therethrough. The present invention also provides a release mechanism that is actuated by hydraulic fluid to effect the release of the packer slips and elements. According to another exemplary embodiment, the present invention features a release mechanism that can be reset to allow the repositioning and resetting of the packer in the well with the possibility of subsequent release of the packer.

BRIEF DESCRIPTION OF THE DRAWINGS

The manner in which these objectives and other desirable characteristics can be obtained is explained in the following description and attached drawings in which.

Figure 1A:
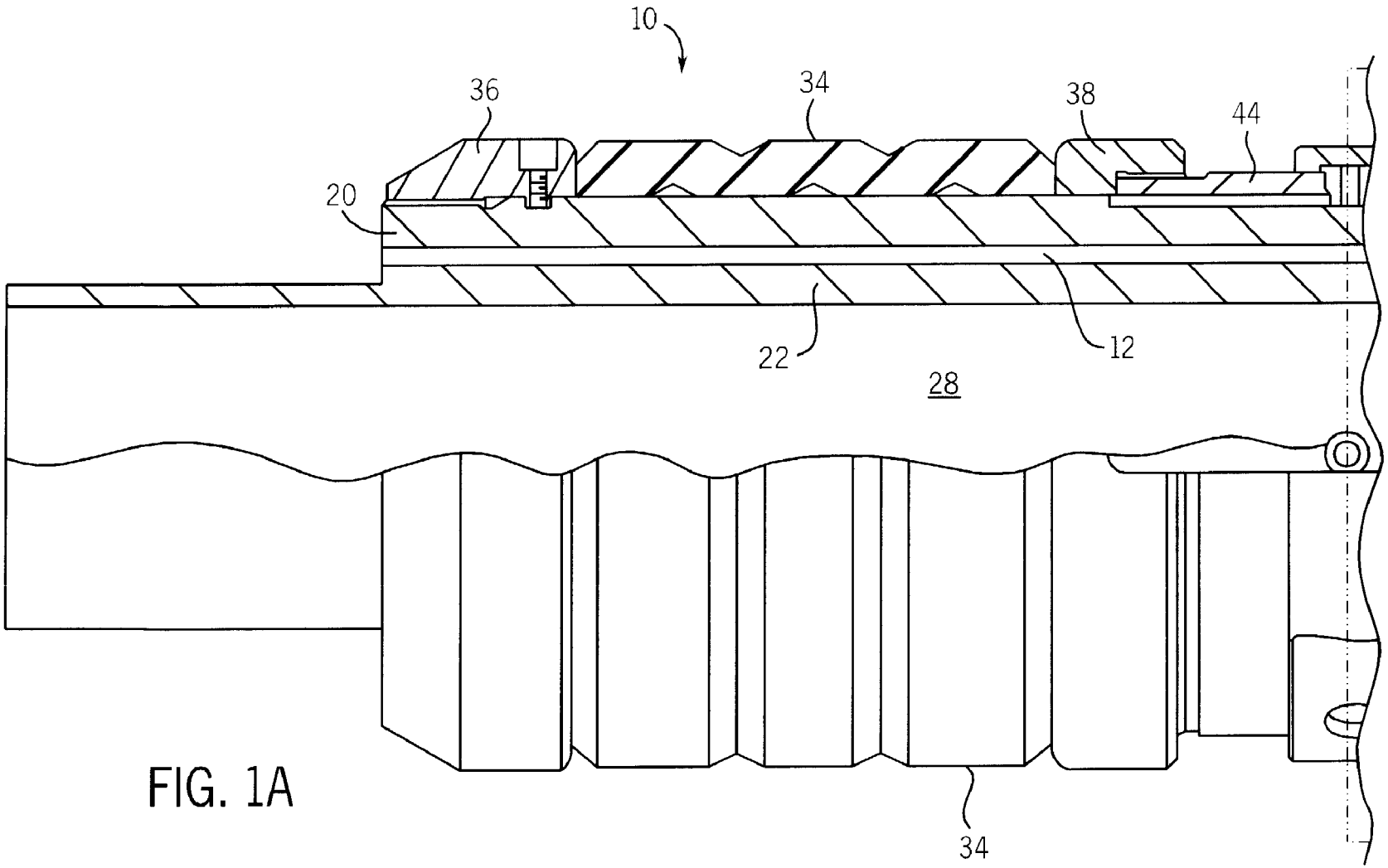
FIGS. 1A–D are cross sectional, side elevational views of the present invention.
Figure 1B:
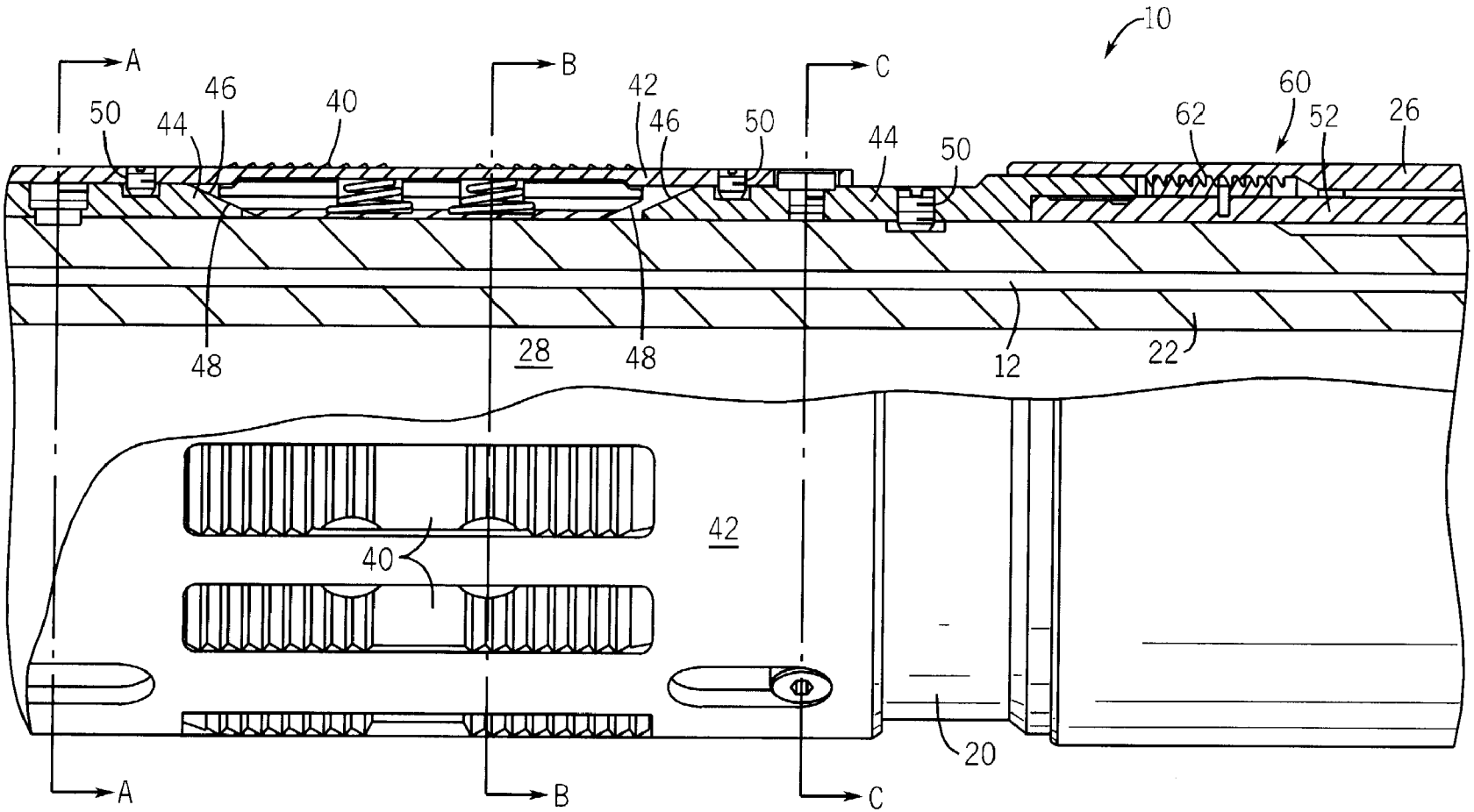
Figure 1C:
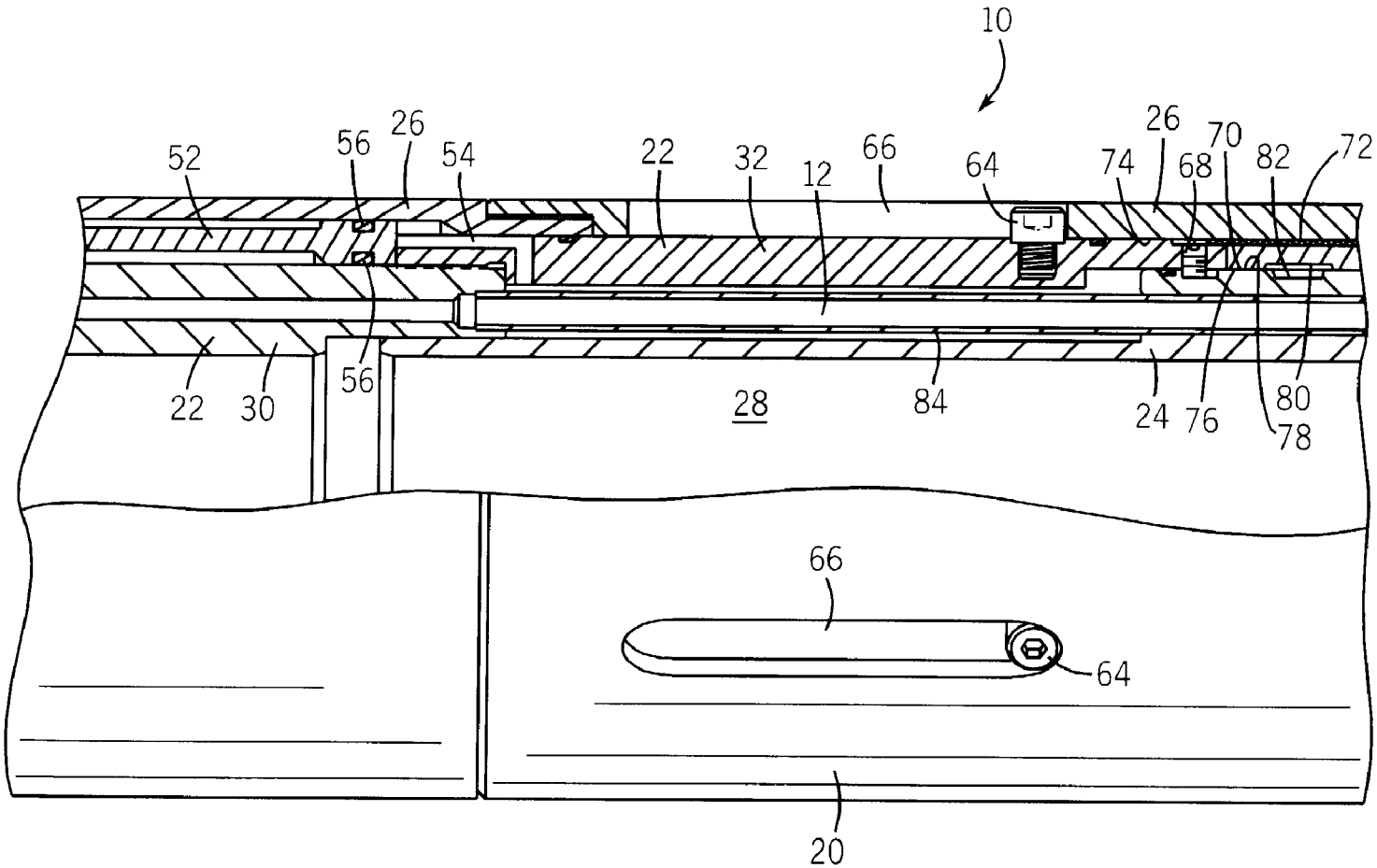

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

The present invention generally provides a releasable well packer 10 having at least one bypass line 12 through the mandrel. The packer 10 preferably includes a release mechanism 14 (see FIGS. 5–8) actuated by applied fluid flow and pressure through a control line 18 extending from the surface and communicating with the packer 10. In an alternative embodiment, the packer 10 is adapted for multiple setting and multiple releasing of the slips 40 and elements 34.

Figure 1D:
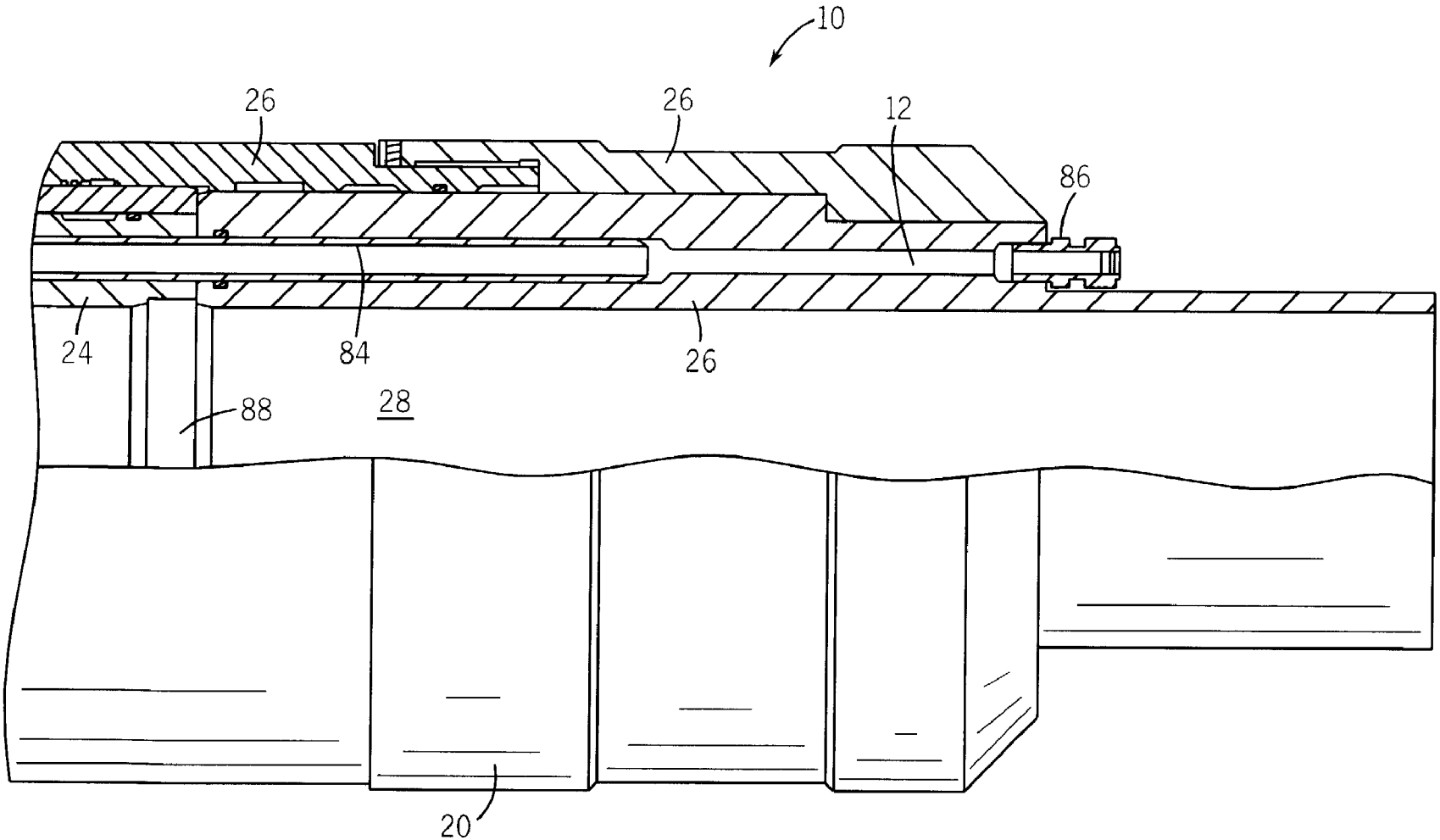

FIGS. 1A–D illustrate a first embodiment of the well packer 10 illustrated in four sections extending from the section illustrated in FIG. 1A to the section illustrated in FIG. 1D. The body 20 of the packer 10 is generally formed of an upper mandrel 22 that is releasably, slideably interconnected to a releasing sleeve 24 and a lower mandrel 26. The body 20 defines a passageway 28 therethrough that is adapted for coaxial alignment with and fluid communication with a tubing string and includes standard connections for attachment to the tubing string to provide fluid communication therethrough. The upper mandrel 22 is formed of a first upper mandrel component 30 and a second upper mandrel component 32. The first and second upper mandrel components 30, 32 are fixedly attached to one another and are hereinafter referred to collectively as the upper mandrel 22.

Similarly, the lower mandrel 26 is formed of four generally interconnected and associated components that do not move relative to one another. For clarity and ease of description these components are collectively referred to herein as the lower mandrel 26. Likewise, the upper mandrel 22, lower mandrel 26, and releasing sleeve 24 are collectively referred to herein as the body or mandrel 20. In general, the upper mandrel 22, lower mandrel 26, and releasing sleeve 24 are releasably attached to one another and do not move relative to one another until the desired release of slips 40 and element 34 of the packer 10.

At least one sealing element 34 is disposed about the upper mandrel 22. The upper position of the sealing elements 34 are established by a shoulder member 36 fixed to the upper mandrel 22. The lower end of the elements 34 abut an element actuator 38 slideably mounted to the upper mandrel 22. A plurality of slips 40 are spaced circumferentially about the upper mandrel 22 at a position below the elements 34 and are secured thereto by a slip cage 42, or other known devices. Slip actuators 44 are slideably mounted to the upper mandrel 22 on either or both longitudinal sides of the slips 40. Actuators 44 have a ramp surface 46 facing cooperating ramp members 48 of the slips 40 to selectively move the slips 40 radially relative to the mandrel between an inwardly retracted running position and an outwardly extended set position.

Shear pins 50 connect the lower slip actuator 44 to the upper mandrel 22 and the slip cage 42 to the upper and lower slip actuators 44 to prevent the relative movement of the slip actuators 44 and the slip cage 42 to the upper mandrel 22, and to prevent movement of the slips 40 to the outwardly extended position until the occurrence of a predetermined event shearing the shear pins 50. The upper slip actuator 44 is fixedly attached to the element actuator 38. Thus, the element actuator 38 is also held in position relative to the upper mandrel 22 and the elements 34 until the setting of the element 34 is desired. Note that the elements 34 and slips 40, their positioning, and their general actuation as described are matters of preference and should not be limiting, as other variations are known, e.g., to position the slips 40 in a different orientation relative to the elements 34.

A setting piston 52 is slideably positioned within the mandrel has an upper end abutting the lower end of the lower slip actuator 44. A setting port 54 provides fluid communication from the passageway 28 through the mandrel to a lower end of the piston. Seals 56 between the setting piston 52 and the mandrel facilitate actuation of the setting piston 52 in response to pressure applied through the tubing, into the passageway 28, through the setting port 54, and to the bottom of the setting piston 52. A locking member 60, preferably comprising cooperating wicker threads 62, restricts the motion of the piston to unidirectional movement in the setting direction (which is upward in the disclosed embodiment). In the disclosed embodiment, the locking member 60 includes a set of wicker threads 62 attached to the setting piston 52 and a cooperating set of wicker threads 62 attached to the lower mandrel 26.

Accordingly, to set the packer 10, sufficient pressure is applied through the tubing and the setting port 54 to the bottom of the setting piston 52 to shear the shear pins 50 holding the slip actuators 44 to the mandrel and the slip cage 42. The setting piston 52 moves upwardly in response to the pressure abutting the lower slip actuator 44 forcing it into the slips 40. The upward force and motion is transmitted to the upper slip actuator 44 which moves upward moving the element actuator 38 upward. The movement of the slip and element actuators 38, 44 forces the slips 40 into the extended set position and compresses the elements 34 creating a seal between the packer 10 and the well casing. The upward motion of the components is locked in by the locking member 60.

A portion of the upper mandrel 22 extends into the lower mandrel 26. A set of bolts 64, or detents, attached to the upper mandrel 22 cooperate with mating slots 66 in the lower . mandrel 26 to maintain their relative rotational orientation. The upper mandrel 22 is releasably connected to the releasing sleeve 24 by a shear pin 68. The upper mandrel 22 is generally releasably connected to the lower mandrel 26 by a set of locking dogs 70 with gripper teeth 72 that mate with gripper teeth 72 on an inner surface 74 of the lower mandrel 26. The locking dogs 70 have an inner surface 76 abutting an outer surface 78 of the releasing sleeve 24. Mating profiles 80, 82 on the inner surface 76 of the dogs 70 and the outer surface 78 of the releasing sleeve 24 allow selective disengagement of the gripper teeth 72 holding the lower mandrel 2640 the locking dog and, thereby the sleeve and upper mandrel 22. In a first, set position of the releasing sleeve 24, wherein the shear pin 68 is intact, the profiles 80, 82 of the locking dogs 70 and the lower mandrel 26 are misaligned to maintain the engagement of the gripper teeth 72 and the relative axial positions of the lower mandrel 26 to the releasing sleeve 24 and the upper mandrel 22.

Conventionally, to release the packer 10, a tool is run into the passageway 28 and locked into a profile 88 formed in the releasing sleeve 24. The releasing sleeve 24 is then mechanically lifted shearing the shear pin 68 connecting the releasing sleeve 24 to the upper mandrel 22. Further upward movement of the releasing sleeve 24 aligns the profiles 80, 82 of the releasing sleeve 24 and the locking dogs 70 allowing the locking dogs 70 to move inwardly away from the lower mandrel 26. Once released, the lower mandrel 26 along with the setting piston 52 connected thereto are free to move downward relative to the upper mandrel 22 releasing the pressure holding the slips 40 and the elements 34 in the set position. The elements 34 and slips 40 are then free to return to the released, retracted position. According to a preferred embodiment of the present invention, hydraulic release mechanism 14 is mounted to selectively force releasing sleeve 24 upward, thus avoiding inadvertent release due to lifting of releasing sleeve 24 (see FIGS. 5–8).

Figure 2:
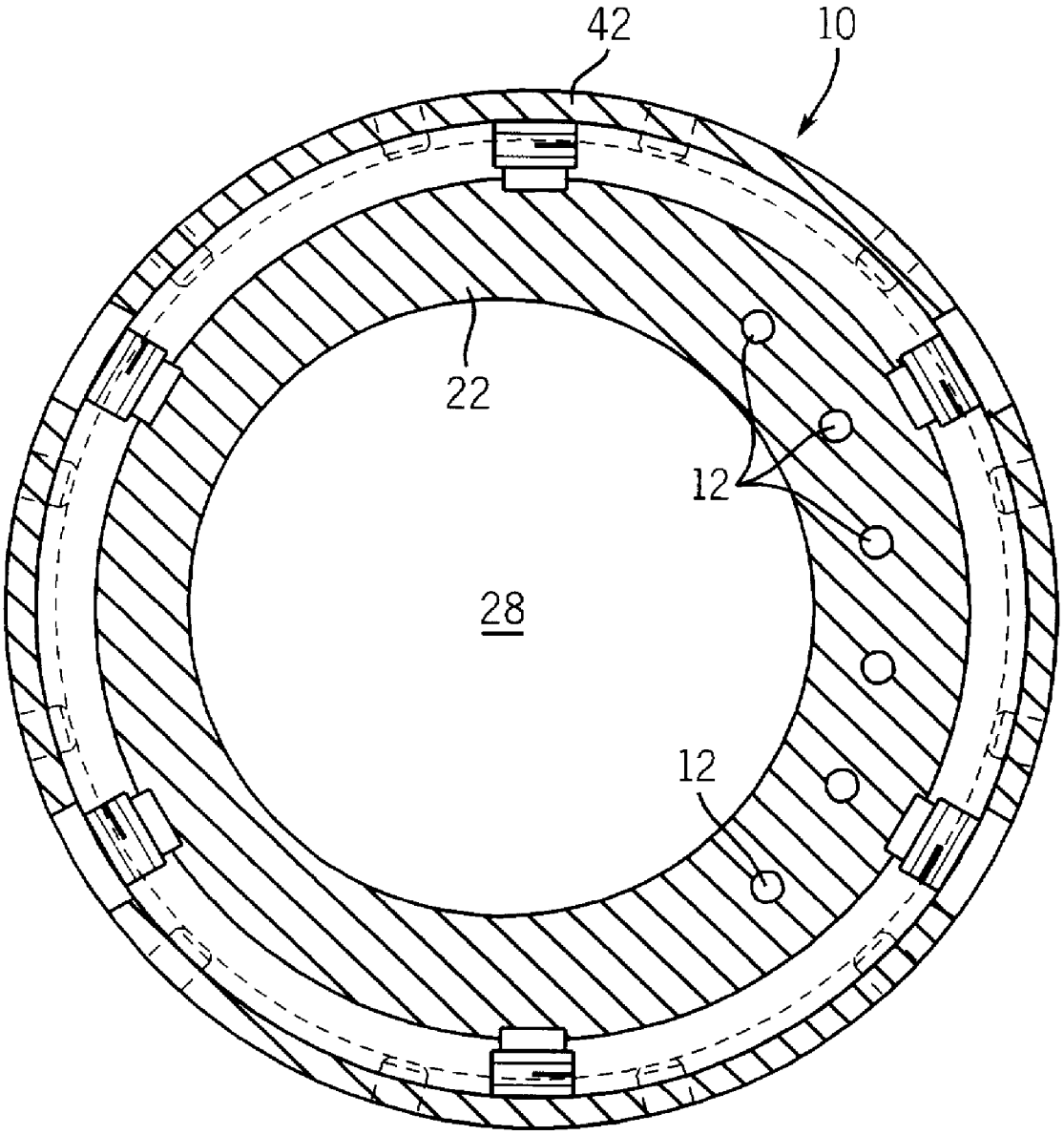
FIG. 2 is a cross sectional view of the present invention taken along lines A—A in FIG. 1A.
Figure 3:
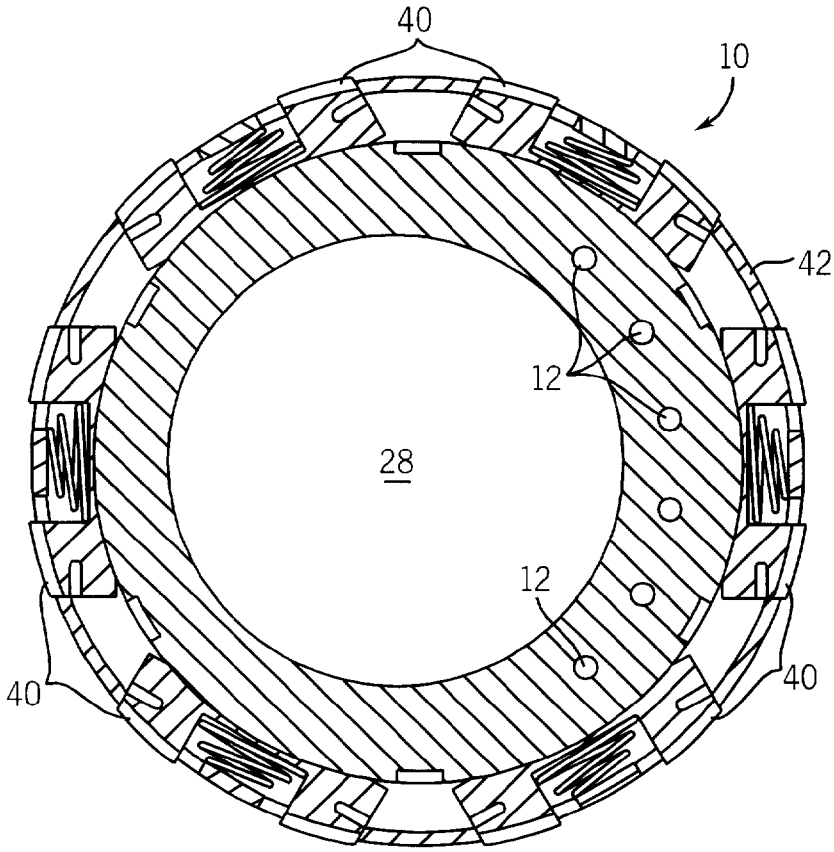
FIG. 3 is a cross sectional view of the present invention taken along lines B—B in FIG. 1B.
Figure 4:
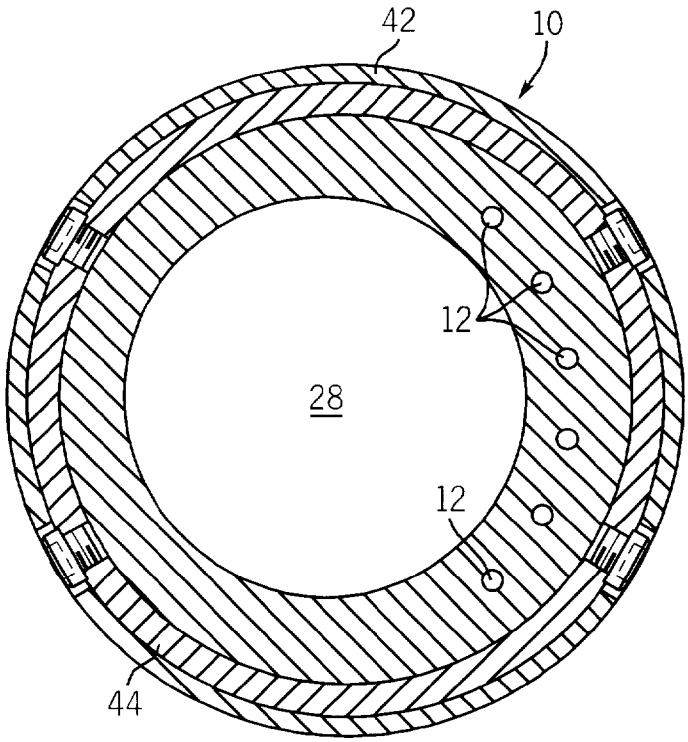
FIG. 4 is a cross sectional view of the present invention taken along lines C—C in FIG. 1B.

FIGS. 2 through 4 are cross sectional views of the packer 10 shown in FIG. 1. In the embodiment shown, the passageway 28 through the mandrel is eccentrically positioned so that the mandrel wall is thicker to one side. One or more bypass lines 12 may then be easily provided through the packer 10 to facilitate the passage of control lines 18 therethrough (see FIG. 4). The eccentric design also facilitates alignment with other eccentric downhole tools in the completion string. As shown in FIG. 1, the bypass lines 12 may include a bypass line tubing 84 within the mandrel extending between the upper mandrel 22 and the lower mandrel 26 to provide a sealed passageway therethrough that allows fluid communication through the bypass line 12, pressure transmission through the bypass line 12, and that provides a protected passageway for control lines 18 extending therethrough. Fittings 86 at the top and bottom of the bypass lines 12 may be used to seal the bypass lines 12. In an alternative embodiment, the passageway 28 is positioned concentrically through the mandrel.

Figure 5:
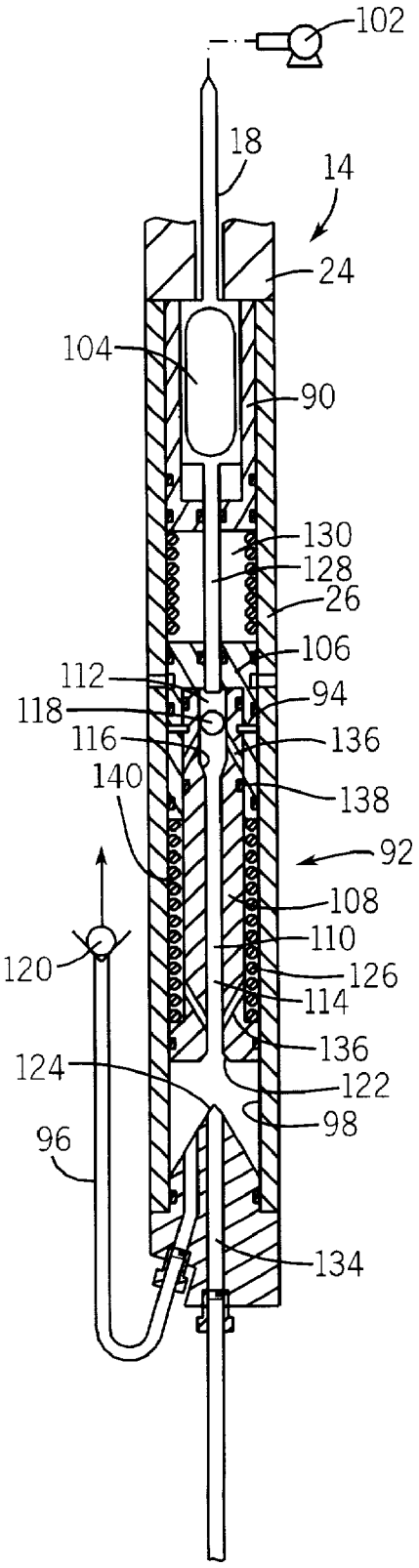
FIG. 5 is a cross sectional, side elevational view of the release mechanism in the open position.

FIG. 5 illustrates a preferred embodiment of a hydraulic release mechanism 14 mounted within the lower mandrel 26 that has a releasing piston 90 adapted to actuate the upward releasing motion of the releasing sleeve 24 in response to pressure and flow. For clarity, the figure shows a blown-up version of the release mechanism 14 with a schematic drawing of the interconnecting communication lines. In general, the release mechanism 14 provides a flow responsive valve 92 fixed in an open position by shear pins 94 and closeable by application of flow and pressure. A bleed-off line 96 communicating with the valve prevents the build-up of pressure in the release mechanism 14 when the flow responsive valve 92 is open. When the flow responsive valve 92 is closed, the pressure bleed-off line 96 is closed and pressure may build in the release mechanism 14. The pressure actuates a releasing piston 90 by moving the piston 90 upward and forcing the releasing sleeve 24 up into the released position. The upward movement of the releasing sleeve 24 causes a release of the slips 40 and elements 34 as previously described. A detailed description of the release mechanism 14 follows.

The lower mandrel 26 defines a cylindrical release mechanism cavity 98 therein that is axially aligned with one of the bypass lines 12 through the packer 10. A control line 18 communicates a control fluid to the release mechanism cavity 98 from a controllable source of fluid 102, such as a pump, preferably located at the surface. Preferably, the release mechanism 14 incorporates an accumulator 104 in the control line 18 to enhance the response of the release mechanism 14 to flow conditions provided from the controllable source of fluid 102.

The flow responsive valve 92 includes a valve cap 106 fixed within the release mechanism cavity 98. An upper portion of a valve piston 108 is sealably positioned within the valve cap 106 and is releasably attached thereto by shear pins 94. The control line 18 extends through the valve cap 106 and into a valve bore 110 defined through the valve piston 108. The valve bore 110 has an enlarged upper portion 112 and a lower portion 114 having a relatively smaller diameter than the upper portion. The change in diameter between the upper portion 112 and the lower portion 114 defines a ball seat 116. A valve ball 118 maintained within the enlarged upper portion 112 of the valve bore 110 has a lower specific gravity than the fluid in the control line 18. Thus, the valve ball 118 floats above the ball seat 116. Further, the diameter of the ball valve is smaller than the diameter of the upper portion 112, but larger than the diameter of the lower portion 114. Therefore, the position of the ball seat 116 is unaffected by pressure in the control line 18 and generally remains off seat. A flow of fluid through the control line 18, however, will act to force the valve ball 118 downward onto the ball seat 116.

A bleed-off line 96 communicates with the release mechanism cavity 98 at a position below the valve piston 108. The opposite end of the bleed-off line 96 communicates with the annulus formed between the tubing and the casing with the bleed-off line 96 preferably extending through a separate bypass line 12 through the packer 10 so that the pressure vents above the packer 10. A check valve 120 in the bleed-off line 96 allows flow from the release mechanism cavity 98 through the bleed-off line 96 only. Therefore, pressure buildup within the release mechanism 14 flows through the flow responsive valve 92 and through the bleed-off line 96 into the annulus of the well. By releasing the pressure within the release mechanism 14, the actuation of the release mechanism 14 based upon pressure alone is prevented. Requiring flow in addition to pressure prevents unsetting of the packer 10 due to inadvertent pressure increases in the control line 18. For example, if a surface valve in the control line 18 were inadvertently closed and the control fluid in the control line 18 expanded due to thermal increases, the pressure in the control line 18 would tend to rise. However, the bleed-off line 96 prevents such a situation from releasing the packer 10.

Figure 6:
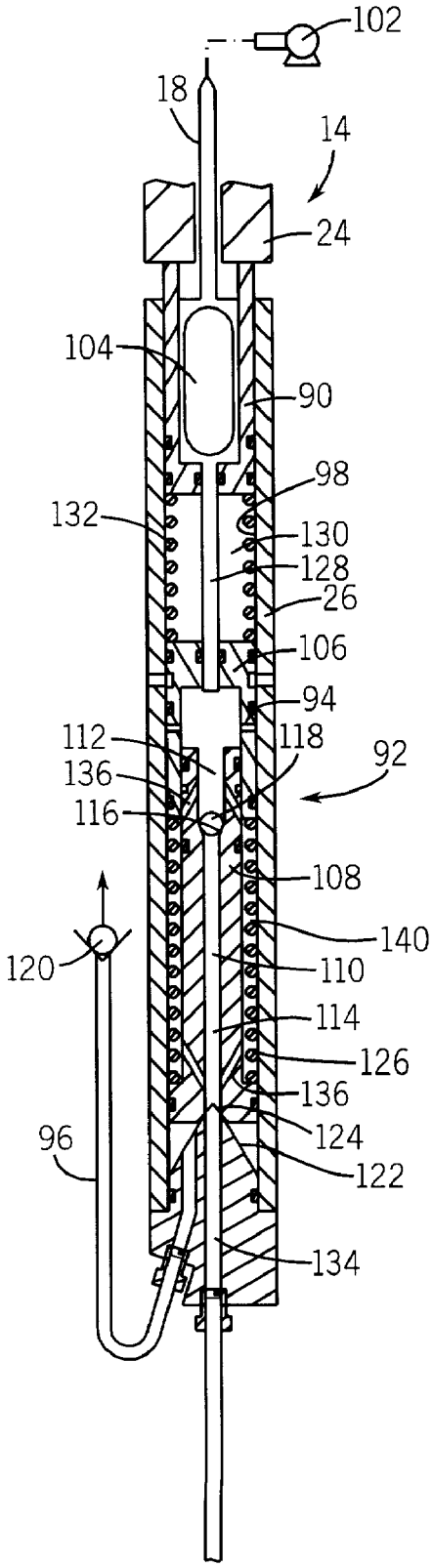
FIG. 6 is a cross sectional, side elevational view of the release mechanism in the closed, released position.

When a flow of fluid is directed through the control line 18, the valve ball 118 engages the valve seat 124. Pressure in the control line 18 builds shearing the shear pins 94 holding the valve piston 108 in place. The pressure forces the valve piston 108 downward so that a piston seat 122 of the valve piston 108 sealably engages and seats on the valve seat located at the bottom of the release mechanism cavity 98. An optional valve spring 126 helps to hold the valve piston 108 in the seated position in the event of loss of flow. When in the seated position, the valve piston 108 sealably closes the bleed-off line 96 allowing pressure to build in the release mechanism 14. Specifically, the fluid flows through communication ports 128 in the control line 18 into a pressure cavity 130 defined between the flow responsive valve 92 and the releasing piston 90 in the release mechanism cavity 98. Once the pressure reaches a sufficient level, the shear pin 68 holding the releasing sleeve 24 to the upper mandrel 22 shears allowing the releasing piston 90 and releasing sleeve 24 to move upward releasing the locking dogs 70 and, ultimately, the packer 10 as previously described. A piston spring 132 biases the releasing piston 90 to an upward, released position. FIG. 6 shows the flow responsive valve 92 closed and the releasing piston 90 and releasing sleeve 24 forced upward to a release position.

Preferably, as shown in FIG. 6, the release mechanism 14 also has a pass through line 134 that provides fluid communication through the release mechanism 14 to additional packers 10 or tools located below the packer 10. The pass through line 134 is preferably axially aligned with the valve bore 110. To facilitate such communication, the valve piston 108 defines auxiliary passageways 136. A first set of auxiliary passageways 136 extend from a position above the valve ball 118 when the valve ball 118 is seated on the ball seat 116 to an exterior of the valve piston 108. Seals 138 between the valve piston 108 and the valve cap 106 positioned below the first set of auxiliary passageways 136 prevent flow through the first set of auxiliary passageways 136 when the flow responsive valve 92 is open (i.e. before the valve piston 108 has moved down on seat). However, after the valve piston 108 moves on seat, the first set of auxiliary passageways 136 communicate fluid from the communication line to a valve annulus 140 formed between the valve piston 108 and the release mechanism cavity 98 wall. A second set of auxiliary passageways 136 defined in the valve piston 108 and providing communication from an exterior of the valve piston 108 to the valve bore 110 are positioned below the seated valve ball 118. Therefore, fluid may flow around the seated valve ball 118, back into the valve bore 110, and into the pass through line 134 without allowing flow into the bleed-off line 96.

Figure 7:
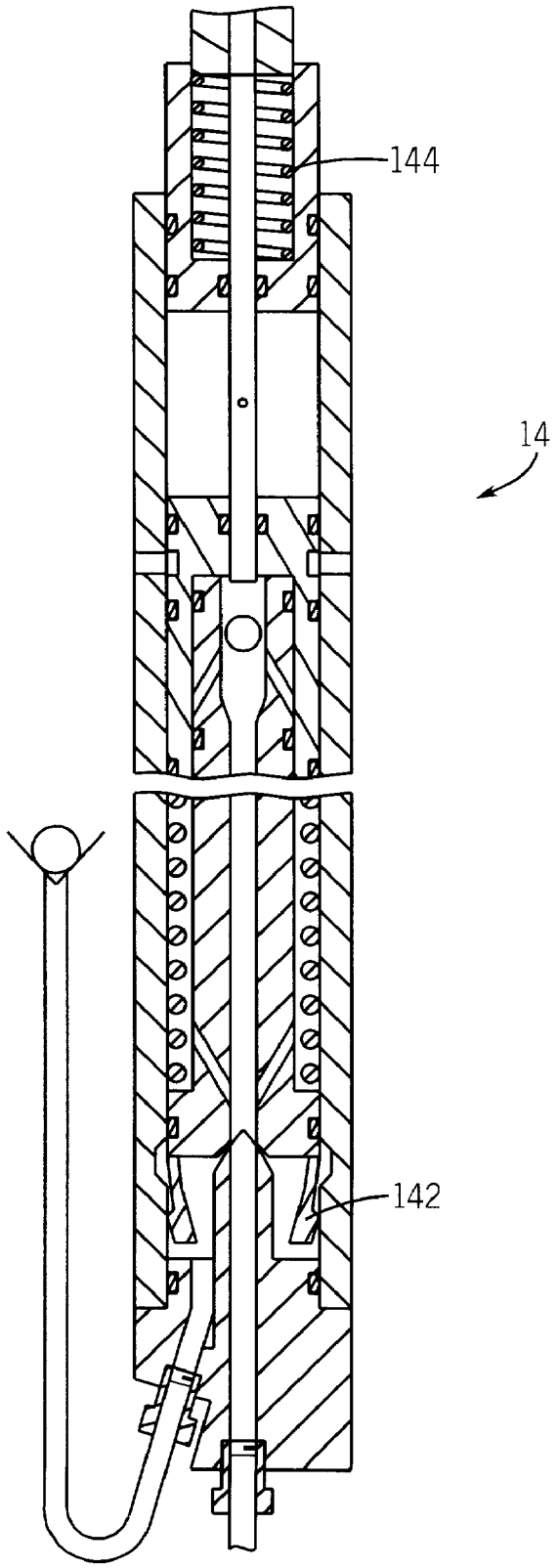
FIG. 7 is a cross sectional, side elevational view of an alternative embodiment for the release mechanism in the closed, released position.
Figure 8:
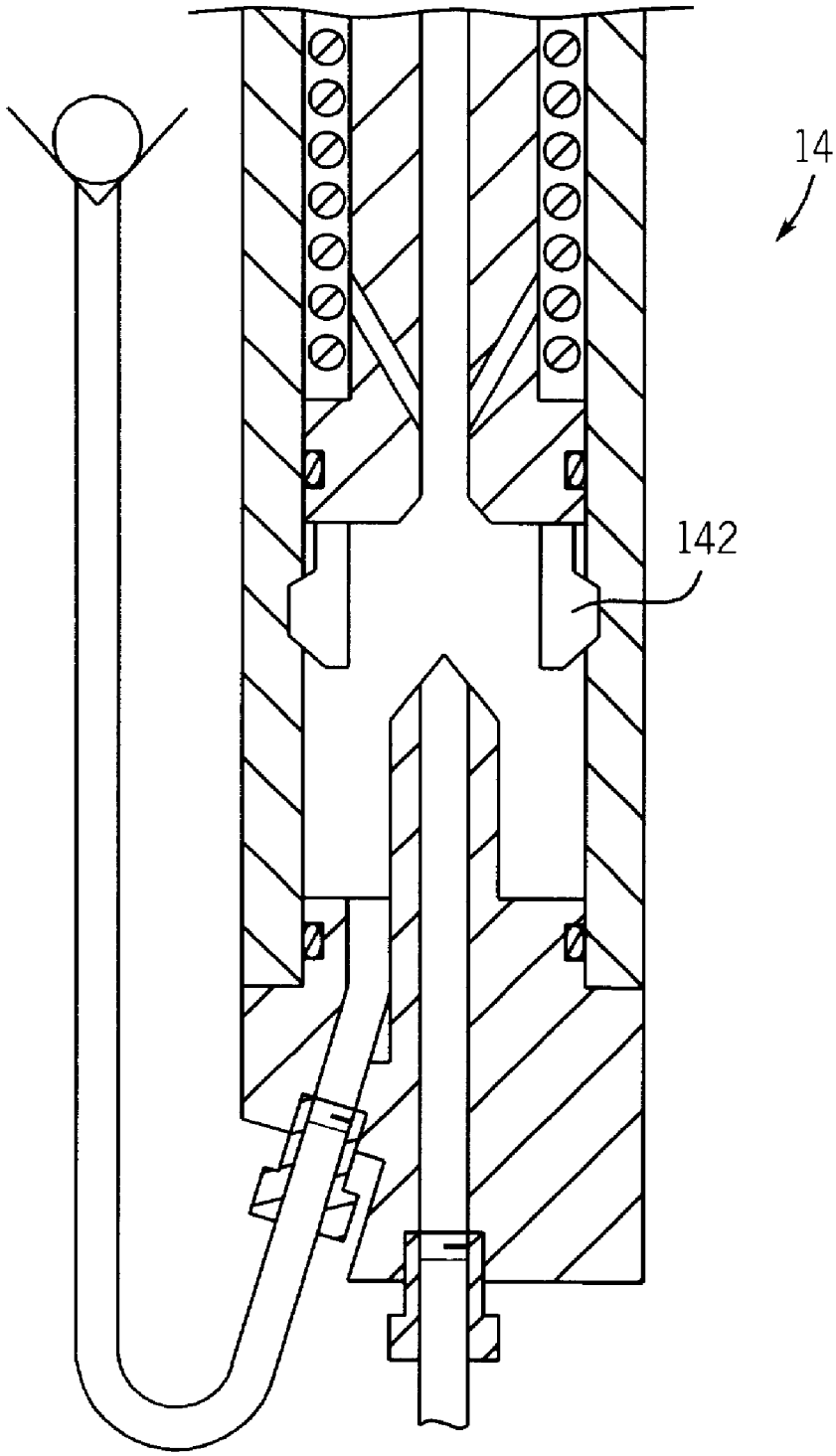
FIG. 8 is a cross sectional, side elevational view of an alternative embodiment for the release mechanism in the open position.

FIGS. 7 and 8 show an alternative embodiment for the release mechanism 14 that allows resetting of the release mechanism 14. In this embodiment, the shear pins 94 are replaced by collets 142 which are nondestructive and may be reset into position. Return springs 144 in the release mechanism 14 bias the release mechanism 14 back to a set position upon removal of pressure. This release mechanism 14 may be combined with a packer 10 having modifications in which the shear pins 50, 68 are replaced by nondestructive type setting members, such as collets. In such an arrangement, the packer 10 may be made to be set, released, and reset a plurality of times.

While the foregoing is directed to the preferred embodiment of the present invention, other and further embodiments of the invention may be devised without departing from the basic scope thereof, and the scope thereof is determined by the claims which follow. It is the express intention of the applicant not to invoke 35 U.S.C. § 112, paragraph 6 for any limitations of any of the claims herein, except for those in which the claim expressly uses the word "means" together with an associated function.

What is claimed is:

1. A packer for use in a subterranean wellbore, comprising:

a mandrel body having a first mandrel portion coupled to a second mandrel portion by a releasing sleeve;

a plurality of slips spaced circumferentially about the first mandrel portion, wherein the plurality of slips move between an outwardly extended set position and an inwardly retracted running position based on movement of the releasing sleeve; and a release mechanism connected to at least one of the first and the second mandrel portions and positioned to selectively move the releasing sleeve upon an independent input, wherein the independent input comprises a hydraulic input delivered by a controllable source of fluid independent of pressure changes in the passageway, wherein the release mechanism comprises a flow responsive valve in fluid communication with the controllable source, the flow responsive valve moving to a closed position upon application of sufficient pressure applied via the controllable source.

2. The packer as recited in claim 1, wherein the release mechanism comprises a pressure bleed-off line that is closed when the flow responsive valve moves to the closed position.

3. The packer as recited in claim 2, wherein the release mechanism comprises a releasing piston positioned to move the releasing sleeve upon sufficient pressure increase intermediate the flow responsive valve and the releasing piston following movement of the flow responsive valve to the closed position.

4. The packer as recited in claim 3, wherein the flow responsive valve is held in an open position by a shear screw.

5. The packer as recited in claim 3 wherein the flow responsive valve is held in an open position by a collet.

6. A packer for use in a subterranean wellbore, comprising:

a mandrel body having a first mandrel portion coupled to a second mandrel portion by a releasing sleeve, wherein the mandrel body includes a passageway adapted for fluid communication with a tubing string, and a setting port to permit fluid communication between the passageway and the setting piston such that sufficient pressure in the passageway results in actuation of the setting piston, wherein the passageway is eccentrically positioned to accommodate a control line;

a plurality of slips spaced circumferentially about the first mandrel portion, wherein the plurality of slips move between an outwardly extended set position and an inwardly retracted running position based on movement of the releasing sleeve; and a release mechanism connected to at least one of the first and the second mandrel portions and positioned to selectively move the releasing sleeve upon an independent input.

7. A packer system for use in a wellbore having a wellbore casing, comprising:

a mandrel body configured for connection to a tubing string and including a separate bypass line;

a plurality of wellbore casing gripping members that may be moved to a set position against the wellbore casing via pressure applied through the tubing string; and a release mechanism coupled to the separate bypass line, wherein upon a sufficient input via the separate bypass line the release mechanism releases the plurality of wellbore casing gripping members from the set position, wherein the separate bypass line comprises a hydraulic control line and the release mechanism is hydraulically actuatable, wherein the release mechanism comprises a flow responsive valve in fluid communication with the hydraulic control line.

8. The packer system as recited in claim 7, wherein the mandrel body comprises a first mandrel portion, a second mandrel portion and a releasing sleeve.

9. The packer system as recited in claim 8, further comprising a sealing element circumferentially disposed about the first mandrel portion.

10. The packer system as recited in claim 9, wherein the plurality of wellbore casing gripping members comprise a plurality of slips.

11. The packer system as recited in claim 10, further comprising a setting piston acuatable to move the sealing element into a radially outward position for sealing engagement with a wellbore casing.

12. The packer system as recited in claim 11 wherein the setting piston is utilized to force the plurality of slips to an outwardly extended set position.

13. The packer system as recited in claim 7, wherein the release mechanism comprises a releasing piston positioned to move the releasing sleeve upon sufficient pressure increase intermediate the flow responsive valve and the releasing piston following movement of the flow responsive valve to the closed position.

14. The packer of claim 7, wherein the mandrel body includes at least one bypass line therethrough.

15. The packer of claim 14 further comprising a bypass line tubing located within at least one of the bypass lines and extending between the first and second mandrel portions.

16. The packer of claim 15 wherein the bypass line tubing provides a sealed passageway through the relevant bypass line between the first and second mandrel portions.

17. A packer for use in a subterranean wellbore, comprising:

a mandrel body having a first mandrel portion coupled to a second mandrel portion by a releasing sleeve, wherein the mandrel body includes at least one bypass line therethrough;

a plurality of slips spaced circumferentially about the first mandrel portion, wherein the plurality of slips move between an outwardly extended set position and an inwardly retracted running position based on movement of the releasing sleeve;

a release mechanism connected to at least one of the first and the second mandrel portions and positioned to selectively move the releasing sleeve upon an independent input; and a bypass line tubing located within at least one of the bypass lines and extending between the first and second mandrel portions.

18. The packer of claim 17, wherein the bypass line tubing provides a sealed passageway through the relevant bypass line between the first and second mandrel portions.

19. A packer for use in a subterranean wellbore, comprising:

a mandrel body having a first mandrel portion coupled to a second mandrel portion by a release sleeve;

the mandrel body including a passageway adapted for fluid communication with a tubing string;

the release sleeve adapted to be shifted from within the passageway; at least one slip, wherein the at least one slip moves between an outwardly extended position and an inwardly retracted position based on the shifting of the release sleeve; and the mandrel body includes at least one bypass line therethrough, wherein a tool selectively disposed within the passageway selectively engages a profile defined on the release sleeve to shift the release sleeve.

20. The packer of claim 19 wherein the mandrel body includes a plurality of bypass lines therethrough.

21. A packer for use in a subterranean wellbore, comprising:

a mandrel body having a first mandrel portion coupled to a second mandrel portion by a release sleeve;

the mandrel body including a passageway adapted for fluid communication with a tubing string;

the release sleeve adapted to be shifted from within the passageway;

at least one slip, wherein the at least one slip moves between an outwardly extended position and an inwardly retracted position based on the shifting of the release sleeve; and the mandrel body includes at least one bypass line therethrough, further comprising a bypass line tubing located within at least one of the bypass lines and extending between the first and second mandrel portions.

22. The packer of claims 21, wherein the bypass line tubing provides a sealed passageway through the relevant bypass line between the first and second mandrel portions.

23. The packer of claim 21, further comprising a bypass line tubing located within each of the bypass lines and extending between the first and second mandrel portions.

24. A packer for use in a subterranean wellbore, comprising:

a mandrel body having a first mandrel portion coupled to a second mandrel portion by a release sleeve;

the mandrel body including a passageway adapted for fluid communication with a tubing string;

the release sleeve adapted to be shifted from within the passageway;

at least one slip, wherein the at least one slip moves between an outwardly extended position and an inwardly retracted position based on the shifting of the release sleeve; and the mandrel body includes at least one bypass line therethrough, wherein the passageway is eccentrically positioned to the mandrel body.

25. A method for selectively actuating and releasing a packer disposed within a wellbore, comprising:

connecting a release sleeve to a mandrel body including a first and a second mandrel portion, the release sleeve coupling the first and second mandrel portions;

providing the mandrel body with at least one bypass line therethrough;

engaging at least one slip disposed on the mandrel body to a wellbore casing to secure the mandrel body at a desired location in the wellbore; and releasing the at least one slip from engagement with the casing by shifting the release sleeve from within a passageway included in the mandrel body, wherein the releasing step comprises deploying a tool within the passageway, securing the tool to a profile defined on the release sleeve, and shifting the release sleeve by manipulating the tool.

26. A packer for use in a subterranean wellbore, comprising:

a mandrel body having a first mandrel portion coupled to a second mandrel portion by a connecting member;

at least one slip, wherein the at least one slip moves between an outwardly extended position and an inwardly retracted position based on the movement of the connecting member;

the mandrel body includes at least one bypass line therethrough;

the mandrel body includes a passageway adapted for fluid communication with a tubing string; and the connecting member at least partially extends within the passageway, wherein the connecting member is moved as a result of a mechanical force.

27. The packer of claim 26, wherein the connecting member is a release sleeve that is concentric with the passageway.

* * * * *